US007415215B2

(12) United States Patent
Yamada

(10) Patent No.: US 7,415,215 B2
(45) Date of Patent: Aug. 19, 2008

(54) IMAGE FORMING SYSTEM AND IMAGE FORMING APPARATUS

(75) Inventor: Akihiro Yamada, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 186 days.

(21) Appl. No.: 11/412,188

(22) Filed: Apr. 27, 2006

(65) Prior Publication Data

US 2006/0245771 A1 Nov. 2, 2006

(30) Foreign Application Priority Data

Apr. 27, 2005 (JP) ..... 2005-129948

(51) Int. Cl.
*G03G 15/00* (2006.01)

(52) U.S. Cl. ..... 399/38; 358/1.14; 399/9; 399/49; 399/81

(58) Field of Classification Search ..... 399/38, 399/81, 43, 49, 75, 9, 80; 347/19; 358/1.14, 358/406, 504

See application file for complete search history.

(56) References Cited

U.S. PATENT DOCUMENTS 6,280,105 B1 8/2001 Iida ..... 400/74
2002/0147723 A1 10/2002 Nagatani
2004/0136025 A1* 7/2004 Moriyama et al. ..... 358/1.14
2006/0008285 A1* 1/2006 Yoshizuka et al. ..... 399/49
2006/0067722 A1* 3/2006 Toyoda et al. ..... 399/80

FOREIGN PATENT DOCUMENTS

JP H05345446 12/1993
JP H1056555 2/1998
JP 2000190573 7/2000
JP 2004-252573 A * 9/2004
JP 2004252573 9/2004

* cited by examiner

*Primary Examiner*—Sophia S Chen
(74) *Attorney, Agent, or Firm*—Baker Botts, LLP

(57) ABSTRACT

An image forming system including: an instruction input unit that allows a user to input a calibration execution instruction for performing a calibration; a restriction setting unit that sets a restriction setting that restricts performing the calibration; a determination unit that determines whether or not to restrict performing the calibration based on the restriction setting; and a control unit that performs the calibration in response to the execution instruction while the determination unit determines that the calibration is allowed to be performed, and ignores the execution instruction while the determination unit determines that the calibration is restricted from being performed.

16 Claims, 8 Drawing Sheets

IMAGE FORMING SYSTEM AND IMAGE FORMING APPARATUS

CROSS REFERENCE TO RELATED APPLICATION

This application claims priority from Japanese Patent Application No. 2005-129948 filed on Apr. 27, 2005, the entire subject matter of which is incorporated herein by reference.

TECHNICAL FIELD

The present invention may relate to an image forming system and an image forming apparatus.

BACKGROUND

Conventionally, in the field of image forming apparatus, calibration is performed commonly to maintain high image quality. For example, there is disclosed in JP-A-2004-252573 a configuration in which calibration can be performed with timing desired by a user. There is disclosed in JP-A-2000-190573 (U.S. Pat. No. 6,280,105 B1) a technique for prohibiting calibration even when the apparatus side determines that the calibration is necessary, if a user restricts execution of the calibration.

In recent years, printers have increasingly come to be used in such a form as to be network-connected via a LAN or the like and thereby be used by plural users. Therefore, in the configuration as described in JP-A-2004-252573 in which calibration can be started by a user, there is a probability that calibration is performed frequently or thoughtlessly by a large number of users. Performing calibration too frequently is not desirable because it generally causes deterioration of expendables and generates noise sound. There is another problem in that a hue, which has been used by a certain user as his or her favorite, is changed suddenly by calibration ordered by another user.

On the other hand, JP-A-2000-190573 discloses a technique for prohibiting, according to a user's request, calibration that the apparatus is going to perform automatically. However, this technique cannot solve the above problem that calibration may be performed frequently or thoughtlessly by a large number of users, because priority is given to a user's request.

SUMMARY

One aspect of the present invention may provide an image forming system including: an instruction input unit that allows a user to input a calibration execution instruction for performing a calibration; a restriction setting unit that sets a restriction setting that restricts performing the calibration; a determination unit that determines whether or not to restrict performing the calibration based on the restriction setting; and a control unit that performs the calibration in response to the execution instruction while determined by the determination unit that the calibration is allowed to be performed, and ignores the execution instruction while determined by the determination unit that the calibration is restricted from being performed.

DETAILED DESCRIPTION

Illustrative aspects of the present invention will be described hereinbelow by reference to the drawings.

First Illustrative Aspect

1. Total Configuration

Figure 1:
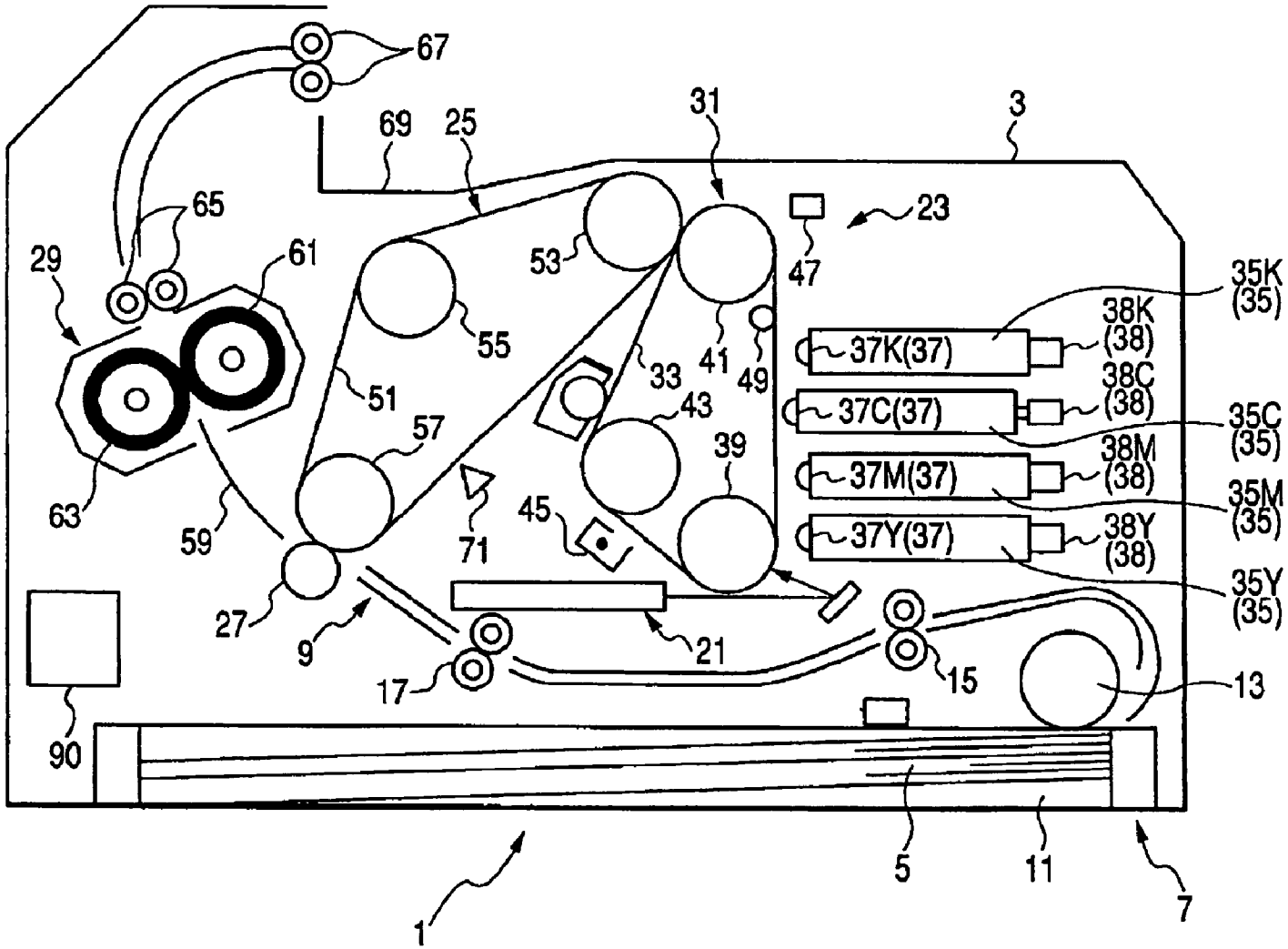
FIG. 1 is a schematic sectional view showing main components of a color laser printer according to a first illustrative aspect.

FIG. 1 is a schematic sectional view showing main components of a color laser printer 1 as an image forming apparatus according to a first illustrative aspect. The color laser printer 1 shown in FIG. 1, which is a 4-cycle type color laser printer, is equipped with, in a main body casing 3, a sheet feed section 7 for feeding a sheet 5, an image forming section 9 for forming an image on the fed sheet 5, and other sections.

The sheet feed section 7 is equipped with a sheet supply tray 11, in which sheets 5 are accommodated in a stacked state; a sheet feed roller 13, which is brought in contact with the top sheet 5 in the sheet supply tray 11 and takes out sheets 5 one by one as it rotates; and transport rollers 15 and registration rollers 17 for transporting a sheet 5 to an image forming position.

The image forming position is a transfer position where a toner image on an inter-transfer belt 51 (described later) is transferred to the sheet 5. In this illustrative aspect, the image forming position is a position where the inter-transfer belt 51 is in contact with a transfer roller 27 (described later).

The image forming section 9 is equipped with a scanner unit 21, a processing section 23, an inter-transfer belt mechanism section 25, the transfer roller 27, and a fusing section 29.

The scanner unit 21 is equipped with, in a central portion inside the main body casing 3, a laser light emitting section, a polygon mirror, plural lenses, and plural reflectors (none of which are shown). In the scanner unit 21, a laser beam that is emitted from the laser light emitting section according to image data passes through or is reflected by the polygon mirror, the reflectors, and the lenses, and then shines on the surface of a photoreceptor belt (OPC: organic photoconductor) 33 of a photoreceptor belt mechanism section 31 (described later) to scan it at high speed.

The process section 23 is equipped with plural (four) development cartridges 35, the photoreceptor belt mechanism section 31, and other components. The four development cartridges 35 are provided in a front portion of the main body casing 3. The four development cartridges 35 are: a yellow development cartridge 35Y, a magenta development cartridge 35M, a cyan development cartridge 35C, and a black development cartridge 35K in which a yellow toner, a magenta toner, a cyan toner, and a black toner are accommodated, respectively, so as to be arranged in this order upward in the vertical direction and oriented parallel with each other with predetermined intervals formed in between.

Each development cartridge 35 is equipped with a development roller 37 (yellow development roller 37Y, magenta development roller 37M, cyan development roller 37C, or black development roller 37K), a layer thickness limiting blade (not shown), a supply roller (not shown), a toner accommodation section (not shown), etc. To let each development cartridge 35 contact or be separated from the surface of the photoreceptor belt 33 (described later), each development cartridge 35 is configured so as to be moved in the horizontal direction by a separation solenoid 38 (yellow separation solenoid 38Y, magenta separation solenoid 38M, cyan separation solenoid 38C, or black separation solenoid 38K).

The development roller 37 is configured in such a manner that a metal roller shaft is covered with a roller which is an elastic member made of a conductive rubber material. More specifically, the roller of the development roller 37 has a two-layer structure consisting of a roller portion, which is an elastic body made of conductive urethane rubber, silicone rubber, EPDM rubber, or the like containing carbon fine particles etc., and a coat layer, which covers the surface of the roller portion and whose main component is urethane rubber, a urethane resin, a polyimide resin, or the like. During development, a predetermined development bias is applied to the development roller 37 with respect to the photoreceptor belt 33. During toner collection, a predetermined collection bias is applied to the development roller 37 with respect to the photoreceptor belt 33. For example, the predetermined development bias is set at +300 V and the predetermined collection bias is set at −200 V.

A non-magnetic one-component toner of yellow, magenta, cyan, or black, which is positively chargeable and spherical, is accommodated in the toner accommodation section of each development cartridge 35. During development, toner is supplied to the development roller 37 as the supply roller rotates, and friction-charged positively between the supply roller and the development roller 37. The toner supplied to the development roller 37 enters the space between the layer thickness limiting blade and the development roller 37 as the development roller 37 rotates, and is again friction-charged there so as to be charged sufficiently. As a result, a thin layer of toner having a predetermined thickness comes to be carried by the development roller 37. During collection, a negative bias is applied to the development roller 37. Toner is collected from the photoreceptor belt 33 and comes to be accommodated in the toner accommodation section.

The photoreceptor belt mechanism section 31 is equipped with: a first photoreceptor belt roller 39; a second photoreceptor belt roller 41; a third photoreceptor belt roller 43; the photoreceptor belt 33, which is wound on the first photoreceptor belt roller 39, the second photoreceptor belt roller 41, and the third photoreceptor belt roller 43; a photoreceptor belt charger 45; a potential application device 47; and a potential gradient controller 49. The structure of the photoreceptor belt mechanism section 31 will be described later in detail.

The inter-transfer belt mechanism section 25, which is disposed behind the photoreceptor belt mechanism section 31, is equipped with: a first inter-transfer belt roller 53, which is opposed to the second photoreceptor belt roller 41 via the photoreceptor belt 33 and the inter-transfer belt (ITB; described later) 51; a second inter-transfer belt roller 55, which is disposed below (behind) the first inter-transfer belt roller 53; a third inter-transfer belt roller 57, which is disposed below (behind) the second inter-transfer belt roller 55 and opposed to the transfer roller 27 (described later) via the inter-transfer belt 51; and the inter-transfer belt 51, which is wound on the first inter-transfer belt roller 53, the second inter-transfer belt roller 55, and the third inter-transfer belt roller 57.

The inter-transfer belt 51 is an endless belt made of a conductive resin, such as polycarbonate or polyimide in which conductive particles of carbon or the like are dispersed. The first inter-transfer belt roller 53, the second inter-transfer belt roller 55, and the third inter-transfer belt roller 57 are located at the vertices of a triangle. The inter-transfer belt 51 is wound thereon. The first inter-transfer belt roller 53 is driven rotationally by a main motor 96 (see FIG. 2; described later) via a drive gear (not shown), and the second inter-transfer belt roller 55 and the third inter-transfer belt roller 57 follow the rotation of the first inter-transfer belt roller 53, whereby the inter-transfer belt 51 circulates clockwise around the first inter-transfer belt roller 53, the second inter-transfer belt roller 55, and the third inter-transfer belt roller 57.

A density detection sensor 71 for detecting a density of each color on the inter-transfer belt 51 is provided. The density detection sensor 71 is composed of a light source for emitting infrared light, a lens for illuminating the inter-transfer belt 51 with the light emitted from the light source, and phototransistors for receiving resulting reflection light.

The transfer roller 27 is disposed so as to be opposed to the third inter-transfer belt roller 57 of the inter-transfer belt mechanism section 25 via the inter-transfer belt 51. The transfer roller 27 is configured in such a manner that a metal roller shaft is covered with a roller made of a conductive rubber material, and is supported rotatably. The transfer roller 27 can be moved by a transfer roller contact/separation mechanism (not shown) between a standby position where it is separated from the inter-transfer belt 51 and a transferable position where it is brought in contact with the inter-transfer belt 51. Two parts of the transfer roller contact/separation mechanism are disposed on both sides of a sheet transport passage 59 in the sheet width direction so as to be opposed to each other. At the transferable position, operated by the transfer roller contact/separation mechanism, the transfer roller 27 presses a sheet 5 going along the transport passage 59 against the inter-transfer belt 51.

In a printing operation (described later), the transfer roller 27 is kept at the standby position while visible images of the respective colors are transferred sequentially to the inter-transfer belt 51. The transfer roller 27 is moved to the transferable position when all the visible images have been transferred from the photoreceptor belt 33 to the inter-transfer belt 51 and a color image has thereby been formed on the inter-transfer belt 51. During calibration, the transfer roller 27 is controlled so as to be located at the standby position.

A predetermined transfer bias is applied to the transfer roller 27 (located at the transferable position) with respect to the inter-transfer belt 51 by a transfer bias application circuit (not shown). The fusing section 29, which is disposed behind the inter-transfer belt mechanism section 25, is equipped with: a heating roller 61; a pressing roller 63, which is pressed against the heating roller 61; and a pair of transport rollers 65 disposed downstream of the heating roller 61 and the pressing roller 63. The heating roller 61 has an outer layer made of silicone rubber and an inner layer made of a metal and is equipped with a halogen lamp for heating.

Next, the photoreceptor belt mechanism section 31 of the image forming section 9 will be described in more detail.

The first photoreceptor belt roller 39 is disposed behind the four development cartridges 35 below the yellow development cartridge 35Y as the bottom development cartridge. The first photoreceptor belt roller 39 is a follower roller.

The second photoreceptor belt roller 41 is disposed over the first photoreceptor belt roller 39 above the black development cartridge 35K as the top development cartridge. The second photoreceptor belt roller 41 is driven rotationally by a main motor (not shown) via a drive gear (not shown).

The third photoreceptor belt roller 43 is disposed above (behind) the first photoreceptor belt roller 39. The third photoreceptor belt roller 43 is a follower roller. As such, the first photoreceptor belt roller 39, the second photoreceptor belt roller 41, and the third photoreceptor belt roller 43 are located at the vertices of a triangle.

The potential +800 V is applied to the second photoreceptor belt roller 41 by the potential application device 47 nearby by using a power source of the photoreceptor belt charger 45. The first photoreceptor belt roller 39 and the third photoreceptor belt roller 43, which are made of a conductive material such as aluminum, are brought in contact with a base layer (described later) of the photoreceptor belt 33 and connected to a ground terminal (not shown). That is, the first photoreceptor belt roller 39 and the third photoreceptor belt roller 43 keep the potential of the portion, in contact with them, of the photoreceptor belt 33 equal to the ground potential.

The photoreceptor belt 33 is wound on the first photoreceptor belt roller 39, the second photoreceptor belt roller 41, and the third photoreceptor belt roller 43. The second photoreceptor belt roller 41 is driven rotationally and the first photoreceptor belt roller 39 and the third photoreceptor belt roller 43 follow the rotation of the second photoreceptor belt roller 41, whereby the photoreceptor belt 33 circulates counterclockwise.

The photoreceptor belt 33 is an endless belt that is configured in such a manner that a 25-mm-thick photoreceptor layer is provided on one surface of a 0.08-mm-base layer (conductive base layer). The base layer is a nickel conductor formed by nickel electrocasting and the photoreceptor layer is a photoreceptor made of a polycarbonate resin.

The photoreceptor belt charger 45 is disposed below the photoreceptor belt mechanism section 31 near the first photoreceptor belt roller 39 (i.e., upstream of the portion, to be exposed by the scanner unit 21, of the photoreceptor belt 33) so as to be spaced from the photoreceptor belt 33 by a predetermined interval to avoid contact. The photoreceptor belt charger 45 is a positively charging scorotron charger which causes corona discharge from a charging wire made of tungsten or the like. The photoreceptor belt charger 45 is configured so as to charge the surface of the photoreceptor belt 33 positively and uniformly.

The potential gradient controller 49 is disposed between the second photoreceptor belt roller 41 and the first photoreceptor belt roller 39 and is brought in contact with the base layer of the photoreceptor belt 33 at a position that is above the black development cartridge 35K. The potential gradient controller 49 makes the potential of the portion, in contact with it, of the base layer equal to the ground potential.

Next, a description will be made of how the color laser printer 1 operates in a printing operation. The printing operation is performed by a controller 90 controlling individual sections (the controller 90 will be described later).

The sheet feed roller 13 is pressed against the top one of the sheets 5 accommodated in the sheet supply tray 11 of the sheet feed section 7, and sheets 5 are taken out one by one as the sheet feed roller 13 rotates. A sheet 5 thus taken out is fed to the image forming position by the transport rollers 15 and the registration rollers 17. The sheet 5 thus fed is registered by the registration rollers 17 in a predetermined manner.

The surface of the photoreceptor belt 33 is charged positively and uniformly by the photoreceptor belt charger 45, and then exposed to a laser beam coming from the scanner unit 21 (i.e., scanned with the laser beam at high speed) according to image data. Charge is eliminated from actually exposed portions, whereby an electrostatic latent image in which positively charged portions and uncharged portions are distributed according to the image data is formed on the surface of the photoreceptor belt 33.

During the course, the first photoreceptor belt roller 39 and the second photoreceptor belt roller 43 supply electricity to portions, in contact with them, of the base layer of the photoreceptor belt 33 and thereby keep the potentials of the contact portions at the ground potential.

The yellow separation solenoid 38Y moves the yellow development cartridge 35Y among the development cartridges 35 rearward in the horizontal direction, whereby the development roller 37 of the yellow development cartridge 35Y is brought into contact with the photoreceptor belt 33 on which the electrostatic latent image is formed.

The yellow toner accommodated in the yellow development cartridge 35Y is charged positively and hence can stick to only uncharged portions of the photoreceptor belt 33 when placed thereon. As a result, a yellow visible image is formed on the photoreceptor belt 33.

At this time, the magenta development cartridge 35M, the cyan development cartridge 35C, and the black development cartridge 35K are separated from the photoreceptor belt 33 because they have been moved forward in the horizontal direction by the separation solenoids 38M, 38C, and 38K.

As the photoreceptor belt 33 is moved, the yellow visible image formed on the photoreceptor belt 33 comes to be opposed to the inter-transfer belt 51. The yellow visible image is transferred to the surface of the inter-transfer belt 51 at that position.

At this time, the positive bias (potential of +300 V) is applied to the second photoreceptor belt roller 41 by using the power source of the photoreceptor belt charger 45. As a result, the portion of the photoreceptor layer adjacent to the second photoreceptor belt roller 41 is also given the potential +300 V via the conductive base layer. Repulsion occurs between the positively charged yellow toner and the photoreceptor layer, which facilitates transfer to the inter-transfer belt 51.

The same procedure as described above is followed for magenta. An electrostatic latent image is formed on the photoreceptor belt 33, and a magenta visible image is formed and transferred to the inter-transfer belt 51.

More specifically, an electrostatic latent image is formed again on the surface of the photoreceptor belt 33. The magenta separation solenoid 38M moves the magenta development cartridge 35M rearward in the horizontal direction, whereby the development roller 37 of the magenta development cartridge 35M is brought into contact with the photoreceptor belt 33. At this time, the yellow development cartridge 35Y, the cyan development cartridge 35C, and the black development cartridge 35K are separated from the photoreceptor belt 33 because they have been moved forward in the horizontal direction by the separation solenoids 38Y, 38C, and 38K. As a result, a magenta visible image is formed on the photoreceptor belt 33 only with magenta toner that is supplied from the magenta development cartridge 35M. As in the case of the yellow procedure, the magenta visible image comes to be opposed to the inter-transfer belt 51 as the photoreceptor belt 33 is moved. The magenta visible image is transferred to the surface of the inter-transfer belt 51 at that position so as to be superimposed on the already transferred yellow visible image.

Similar operations are performed repeatedly by using the cyan toner which is accommodated in the cyan development cartridge 35C and the black toner which is accommodated in the black development cartridge 35K, whereby a color image is formed on the inter-transfer belt 51.

The color image formed on the inter-transfer belt 51 is transferred fully to a sheet 5 by the transfer roller 27 being located at the transferable position as the sheet 5 passes between the inter-transfer belt 51 and the transfer roller 27.

The heating roller 61 of the image forming section 9 thermally fuses the color image that has been transferred to the sheet 5 as the sheet 5 passes between the heating roller 61 and the pressing roller 63.

The sheet 5 onto which the color image has been thermally fused in the fusing section 29 is transported to a pair of sheet ejection rollers 67 by the transport rollers 65. The sheet 5 that has been sent to the sheet ejection rollers 67 is ejected by the sheet ejection rollers 67 onto a sheet ejection tray 69 which is formed at the top of the main body casing 3.

The color printing on the sheet 5 is thus completed.

2. Electrical Configuration

Next, the electrical configuration of the laser printer 1 will be described.

Figure 2:
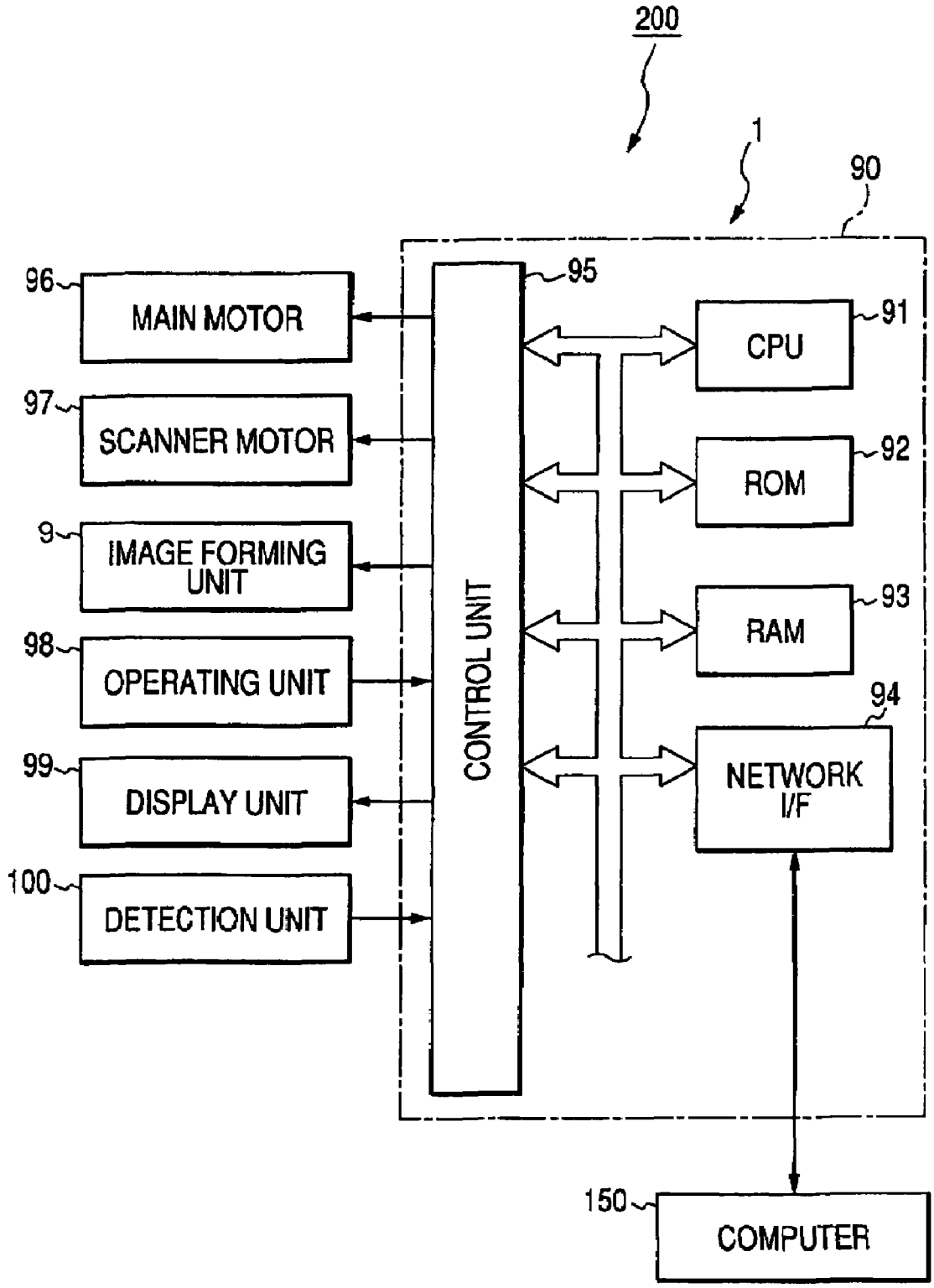
FIG. 2 is a block diagram showing an electrical configuration of the color laser printer of FIG. 1.

FIG. 2 is a block diagram showing the electrical configuration of the laser printer 1 conceptually.

In the laser printer 1, as shown in FIG. 2, a controller 90 which controls individual components is composed of a CPU 91, a ROM 92, a RAM 93, and a control section 95 which is an ASIC (application-specific integrated circuit). A main motor 96, a scanner motor 97, an operating section 98 consisting of an input panel etc., a display section 99 consisting of various lamps etc., a detection section 100 consisting of various sensors etc., and other components are provided so as to be electrically connected to the control section 95. A control system is formed in the above manner.

The ROM 92 and the RAM 93 are connected to the CPU 91, and the CPU 91 controls the individual components via the control section 95 according to processing procedures stored in the ROM 92 while storing processing results in the RAM 93.

The main motor 96 is a motor for rotating the second photoreceptor belt roller 41, the first inter-transfer belt roller 53, etc. in a synchronized manner. The scanner motor 97 is a motor for rotating the polygon mirror etc. in the scanner unit 21.

The CPU 91 controls the driving of the main motor 96 and the scanner motor 97 according to programs that are stored in the ROM 92 in advance.

The control section 95 controls the image forming section 9 according to instructions from the CPU 91. More specifically, the control section 95 performs an exposure control to expose the surface of the photoreceptor belt 33 using the components of the scanner unit 21, performs a transfer bias control when toner images are transferred from the inter-transfer belt 51, and performs other controls.

The controller 90 is also equipped with a network interface 94 for connection to an external apparatus such as a personal computer. The network interface 94 is connected to a computer 150, and the laser printer 1 and the computer 150 constitute an image forming system 200. The CPU 91 performs processing of forming an image on a sheet 5 (recording surface) on the basis of image data that are input from the computer 150 via the network interface 94.

The detection section 100 is composed of the above-mentioned density detection sensor 71, a sheet sensor for detecting the density of a sheet 5, and other various sensors. These sensors are electrically connected to the control section 95.

3. Characteristic Features

Next, characteristic features of the illustrative aspect will be described.

The color laser printer 1 according to the illustrative aspect is configured in such a manner that a user can input a calibration execution instruction and calibration can be performed in response to the input execution instruction. On the other hand, a restriction setting for restricting calibration can also be made. Whether to prohibit calibration corresponding to an execution instruction is determined according to the restriction setting. The calibration corresponding to the execution instruction is not performed if it is determined that the calibration should be prohibited, and the calibration is performed if it is determined that the calibration need not be prohibited. In the illustrative aspect, the operating section serves as "an instruction input unit," and the CPU 91 serves as "a control unit," "a restriction setting unit," and "a determination unit." A specific control flow for realizing the above concept will be described below.

In the color laser printer 1, a display panel is provided as the display section 99. The display panel can display plural menu names, and a desired one of the displayed menu names can be selected by manipulating the operating section 98. If one of the menu names displayed on the display panel is selected ("yes" at step S10), the process moves to step S20. If an execution restriction setting menu is selected at step S20 ("yes" at step S20), an execution restriction process is executed at step S30.

Figure 4:
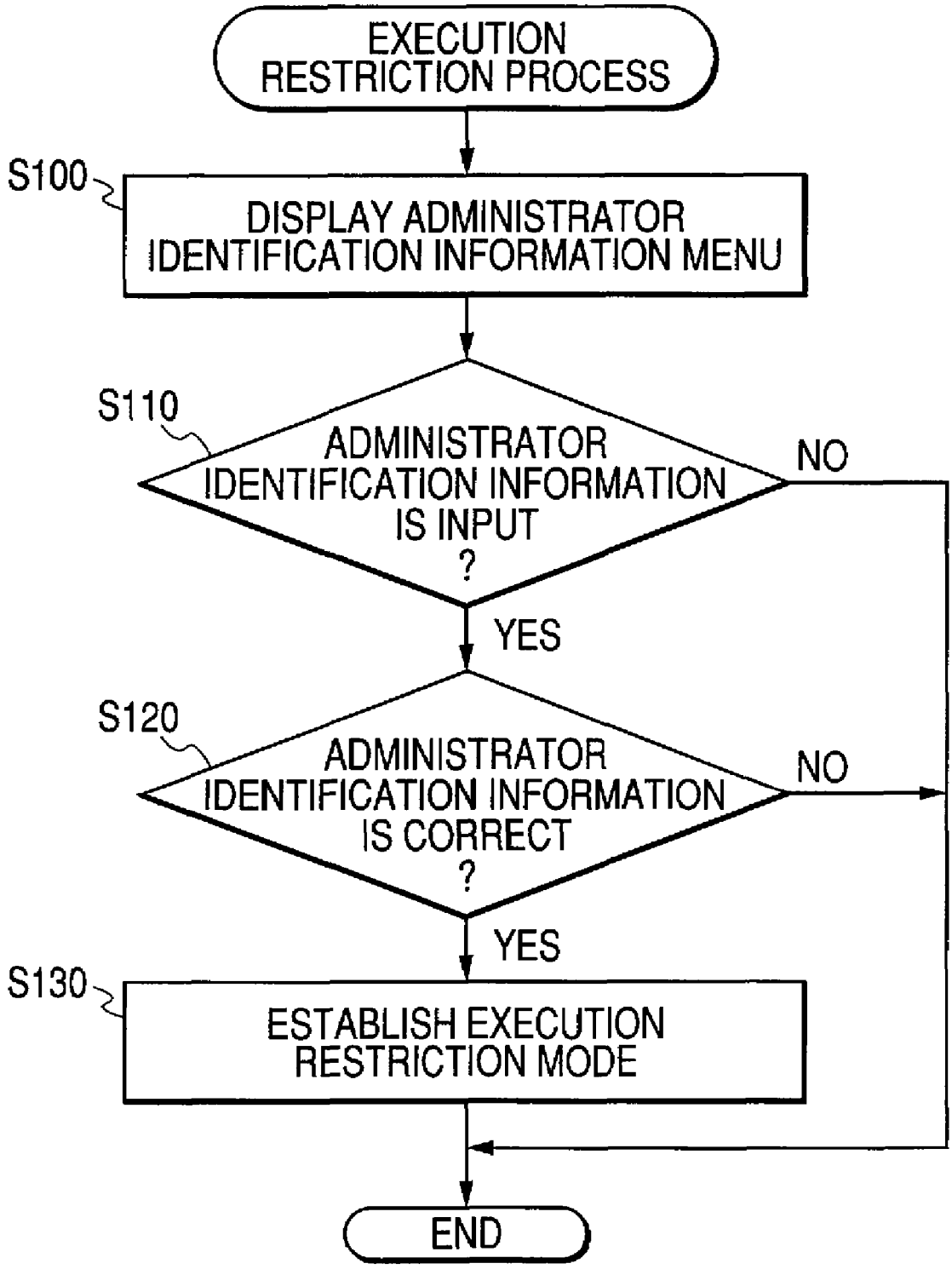
FIG. 4 is a flowchart of an execution restriction process.

As shown in FIG. 4, in the execution restriction process, first, a menu which prompts the user to input administrator identification information (e.g., a combination of characters and numerals) is displayed at step S100. If administrator identification information is input in a predetermined period ("yes" at step S110), the process moves to step S120, where the input administrator identification information is compared with pre-registered information, and it is determined whether the administrator identification information is correct. On the other hand, if administrator identification information is not input in the predetermined period ("no" at step S110), this process is finished. The registered information may be either information that can be changed by an input manipulation or information that is unique to the apparatus and hence cannot be changed. If the administrator identification information is correct ("yes" at step S120), an execution restriction mode is established at step S130. This setting is made by storing, in a storage unit such as the RAM 93 or a nonvolatile memory, information indicating that the execution restriction mode is established. On the other hand, if the administrator identification information is not correct ("no" at step S120), the execution restriction mode is not established and this process is finished.

Figure 3:
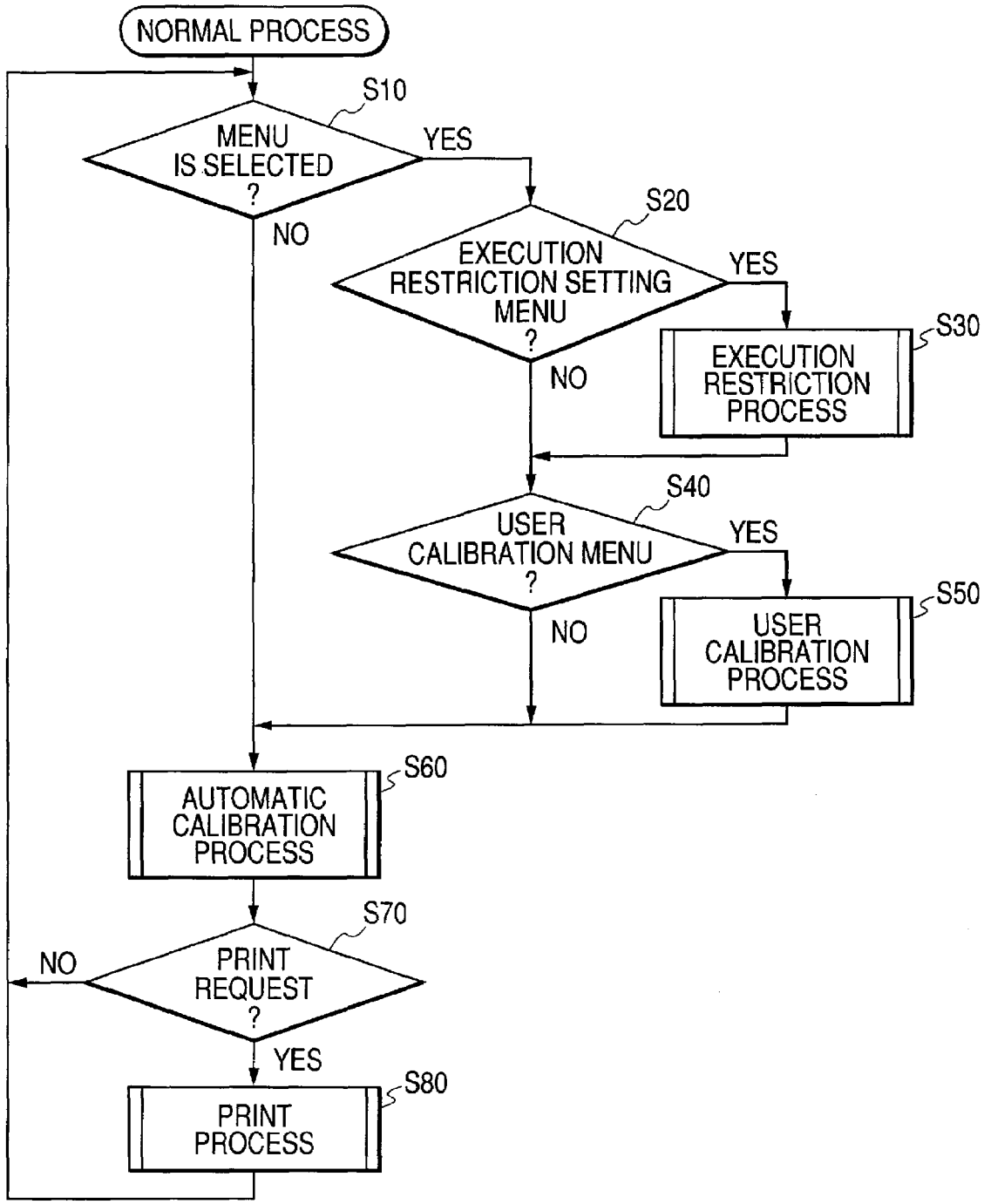
FIG. 3 is a flowchart of an normal process.

In this configuration, a restriction setting is made according to an arbitrary input manipulation by an administrator who intends to start the execution restriction process. In this configuration, an administrator can determine, when necessary, whether to restrict engine calibration (described later), which increases the convenience. The term "administrator" means a user who performs an input manipulation for a restriction setting and may be either the same user as or a different user (e.g., a manager of the color laser printer 1) from the user who inputs a calibration execution instruction (i.e., the user who selects execution of a user calibration process at step S40 (FIG. 3) and inputs a password at step S210 (FIG. 5)).

Returning to FIG. 3, if the execution restriction setting menu is not selected ("no" at step S20), the process moves to step S40. If a user calibration menu is selected ("yes" at step S40), the user calibration process is executed at step S50.

Figure 5:
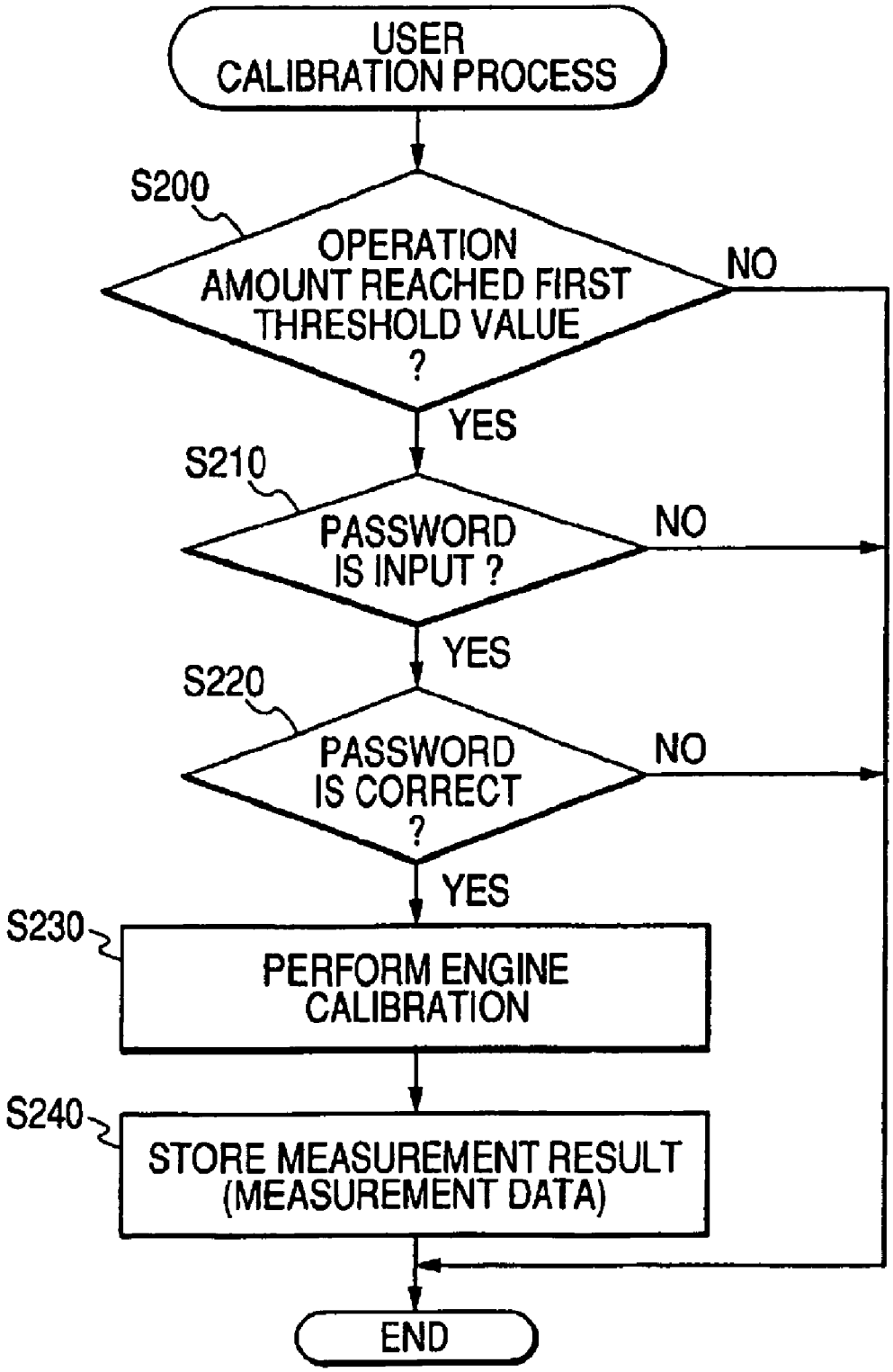
FIG. 5 is a flowchart of a user calibration process.

As shown in FIG. 5, in the user calibration process, an engine calibration process (described later) is executed in response to an execution instruction of an authorized user. First, it is determined at step S200 whether or not an operation amount, as measured from the preceding engine calibration, has reached a first threshold value. More specifically, the operation amount is evaluated by the number of printed sheets. If the number of printed sheets as measured from the preceding engine calibration has not reached a number corresponding to the first threshold value ("no" at step S200), the user calibration process is finished. That is, if the operation amount (the number of printed sheets) as measured from the preceding engine calibration is smaller than the first threshold value ("no" at step S200), it is determined that engine calibration need not be performed in response to the execution instruction. With this measure, engine calibration can be omitted at a stage of a small operation amount at which no serious problems will occur even if engine calibration is not performed. Therefore, the frequency of engine calibration operations can be reduced effectively without lowering the image quality.

If the number of printed sheets as measured from the preceding engine calibration has reached the number corresponding to the first threshold value ("yes" at step S200), the user is prompted to input a password (example of the "authentication information" in the claims). If a password is input in a predetermined time ("yes" at step S210), the process moves to step S220, where the input password is compared with a registered password that is stored in a storage unit and it is determined whether or not the input password is correct. If a password is not input in the predetermined time ("no" at step S210), this process is finished. The registered password may be either information that is unique to the apparatus and hence cannot be changed or information that can be changed by a certain method (e.g., a setting changing manipulation by an authorized user). Although the "registered password" is a different concept than the "registered information" to be used for checking correctness of administrator identification information, in practice the former may be either the same as or different from the latter.

If the input password is correct ("yes" at step S220), engine calibration (described later) is performed at step S230. If the input password is determined in correct ("no" at step S220), this process is finished.

According to the above steps, a password as authentication information is input by a user and whether to perform engine calibration in response to the execution instruction is determined on the basis of whether or not the password is a regular one. Since users capable of starting engine calibration can be discriminated by using the password, engine calibration is prevented from being started thoughtlessly by indefinite users.

Figure 6:
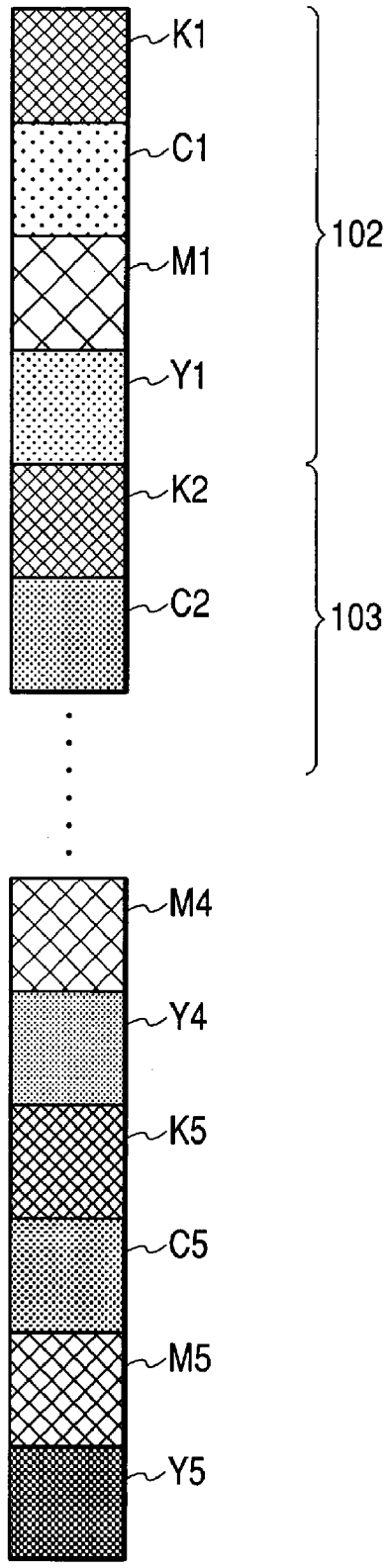
FIG. 6 is an explanatory diagram showing exemplary density patches.

In the engine calibration process of step S230, a density measurement process is executed in which density patches are formed and their densities are measured. In the density measurement process, first, a patch array as shown in FIG. 6 is printed on the inter-transfer belt 51 (see FIG. 1). The patch array is formed on the inter-transfer belt 51 so as to form a continuous straight line that extends along the circulation direction of the inter-transfer belt 51 and is shorter than the circumference. The patch array is a combination of patch groups of the respective colors. More specifically, black density patches are black marks K1, K2, . . . , K5 (K3 and K4 are omitted in FIG. 6) and cyan density patches are cyan marks C1, C2, . . . C5 (C3 and C4 are omitted in FIG. 6). Magenta density patches and yellow density patches are formed likewise. The density patches are arranged in such a manner that the first density patches of the respective colors belong to a group 102, the second density patches of the respective colors belong to a group 103, and so forth.

After the patch array has been formed, densities of the respective patches of the patch array are measured. This is done in such a manner that the density detection sensor 71 measures densities of the patch array on the inter-transfer belt 51 as the inter-transfer belt 51 is circulated. Since the patch array is formed so as to extend along the circulation direction of the inter-transfer belt 51 and to be shorter than the circumference, the density detection sensor 71 can measure densities of all the patches of the patch array by causing the inter-transfer belt 51 to make only a one-round circulation.

At step S240, the measured densities as a measurement result are stored in the storage unit such as the RAM 93 or a nonvolatile memory (e.g., EEPROM; not shown).

According to the above process, a user can start density measurement processing arbitrarily and hence can acquire density information with timing the user desires. On the other hand, if such density measurement processing were permitted unconditionally, trouble (e.g., undue consumption of the developers and noise sound) would occur due to increase in the frequency of execution of density measurement processing. In contrast, the above process can reduce the frequency of formation of density patches and, hence, can effectively prevent such trouble as undue consumption of the developers and noise sound that would be caused by increase in frequency because whether to permit execution of the engine calibration process is determined on the basis of an input password.

Returning to FIG. 3, if no menu is selected at step S10 or if the execution restriction menu or the user calibration menu is selected and its execution is finished because of full execution, cancellation, or the like, an automatic calibration process is executed at step S60.

Figure 7:
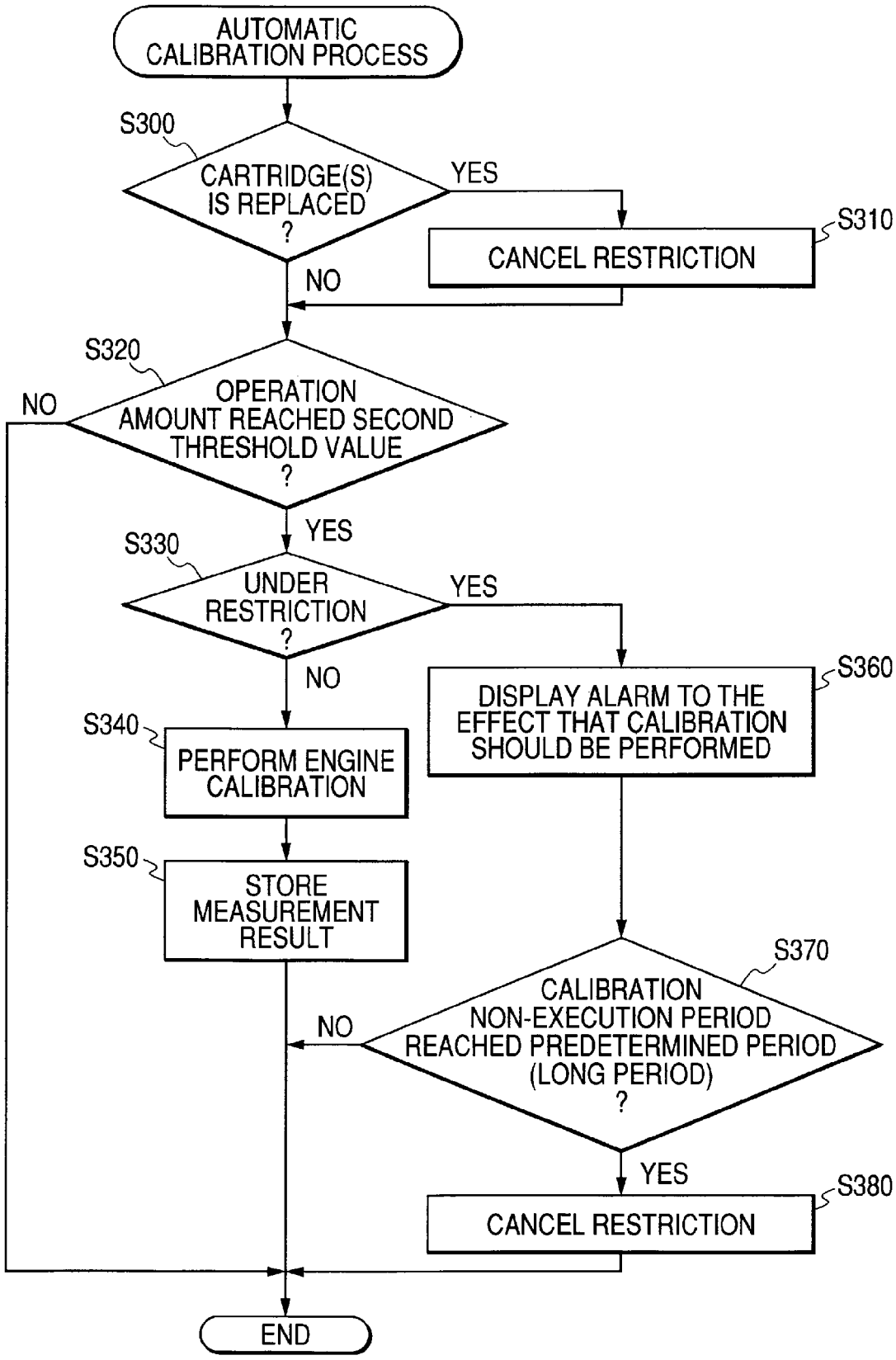
FIG. 7 is a flowchart of an automatic calibration process.

As shown in FIG. 7, in the automatic calibration process, first, it is determined at step S300 whether or not at least one development cartridge 35 has been replaced after the preceding engine calibration. If at least one development cartridge 35 has been replaced ("yes" at step S300), the execution restriction mode is canceled at step S310. If no development cartridge has been replaced ("no" at step S300), the process moves to step S320.

With the above measure, engine calibration is performed irrespective of whether a restriction setting is made if at least one development cartridge 35 has been replaced. That is, after replacement of a development cartridge(s) 35 when the characteristics likely change, it is determined that engine calibration should be performed under predetermined conditions. Therefore, whereas engine calibration to be performed in response to a user's request is restricted moderately, engine calibration is performed properly in a situation that it should be performed.

At step S320 (see FIG. 7), it is determined whether or not the number of printed sheets (operation amount) as measured from the preceding engine calibration has reached a number corresponding to a second threshold value. If the number of printed sheets has not reached the number corresponding to the second threshold value ("no" at step S320), this process is finished. If the number of printed sheets has reached the number corresponding to the second threshold value ("yes" at step S320) the process moves to step S330, where it is determined whether or not the execution restriction mode is established. If the execution restriction mode is not established ("no" at step S330), engine calibration is performed at step S340 and a measurement result is stored in the storage unit at step S350. After replacement of a development cartridge (s), since the restriction is canceled at step S310, the determination result of step S330 should be "no" and hence engine calibration is performed.

On the other hand, if the execution restriction mode is established ("yes" at step S330), the process moves to step S360, where an alarm (notification) to the effect that engine calibration should be performed is issued. That is, in this process, a notification that prompts a user to request engine calibration is issued when the number of printed sheets (operation amount) as measured from the preceding engine calibration has become larger than or equal to the number corresponding to the second threshold value. For example, the notification is given by displaying such a sentence as "Request calibration" on the display panel as the display section 99. In this illustrative aspect, the display section 99 corresponds to the "notification unit".

In the configuration in which engine calibration is restricted according to a restriction setting as in the case of the illustrative aspect, a situation may occur that engine calibration is not performed over a long period, which may result in undue deterioration in image quality. In view of this, in this illustrative aspect, a notification is issued if the operation amount, as measured from the preceding engine calibration, has become larger than or equal to the second threshold value. Therefore, if engine calibration has not been performed over a long period, a user can know that fact and, hence, can take a proper measure such as requesting another user who knows the password to cause calibration. This effectively prevents the apparatus from operating in a state of low image quality.

Further, if the engine calibration non-execution period has reached a predetermined long period ("yes" at step S370), the execution restriction mode is canceled at step S380 and this process is finished. If the engine calibration non-execution period has not reached the predetermined long period ("no" at step S370), this process is finished. In this illustrative aspect, a determination result "the engine calibration non-execution period has reached the predetermined long period" is produced if the number of printed sheets (operation amount) as measured from the preceding engine calibration has become larger than or equal to a number corresponding to a third threshold value (larger than or equal to the second threshold value). According to this process, if the number of printed sheets (operation amount) as measured from the preceding engine calibration has become larger than or equal to the number corresponding to the third threshold value, the restriction is canceled even if the execution restriction mode is established, and engine calibration will be performed when the automatic calibration process is executed next time (S320: yes; S330: no).

In the printer 1, it is preferable to configure the three threshold values to satisfy the following relational expression: "the first threshold value<the second threshold value<the third threshold value."

With the above measure, whereas engine calibration to be performed in response to a user's request is restricted moderately according to a restriction setting, engine calibration is performed irrespective of whether a restriction setting is made if the operation amount has reached a certain level. This prevents the apparatus from operating in a state of low image quality, whereby the image quality is kept high.

In the illustrative aspect, although the first, second, and third threshold values are different concepts, two or all of them may have the same value or all of them may have different values (however, the third threshold value should be larger than or equal to the first and second threshold values).

Next, a print process will be described.

If a print request is made at step S70 (see FIG. 3), a print process is executed at step S80.

Figure 8:
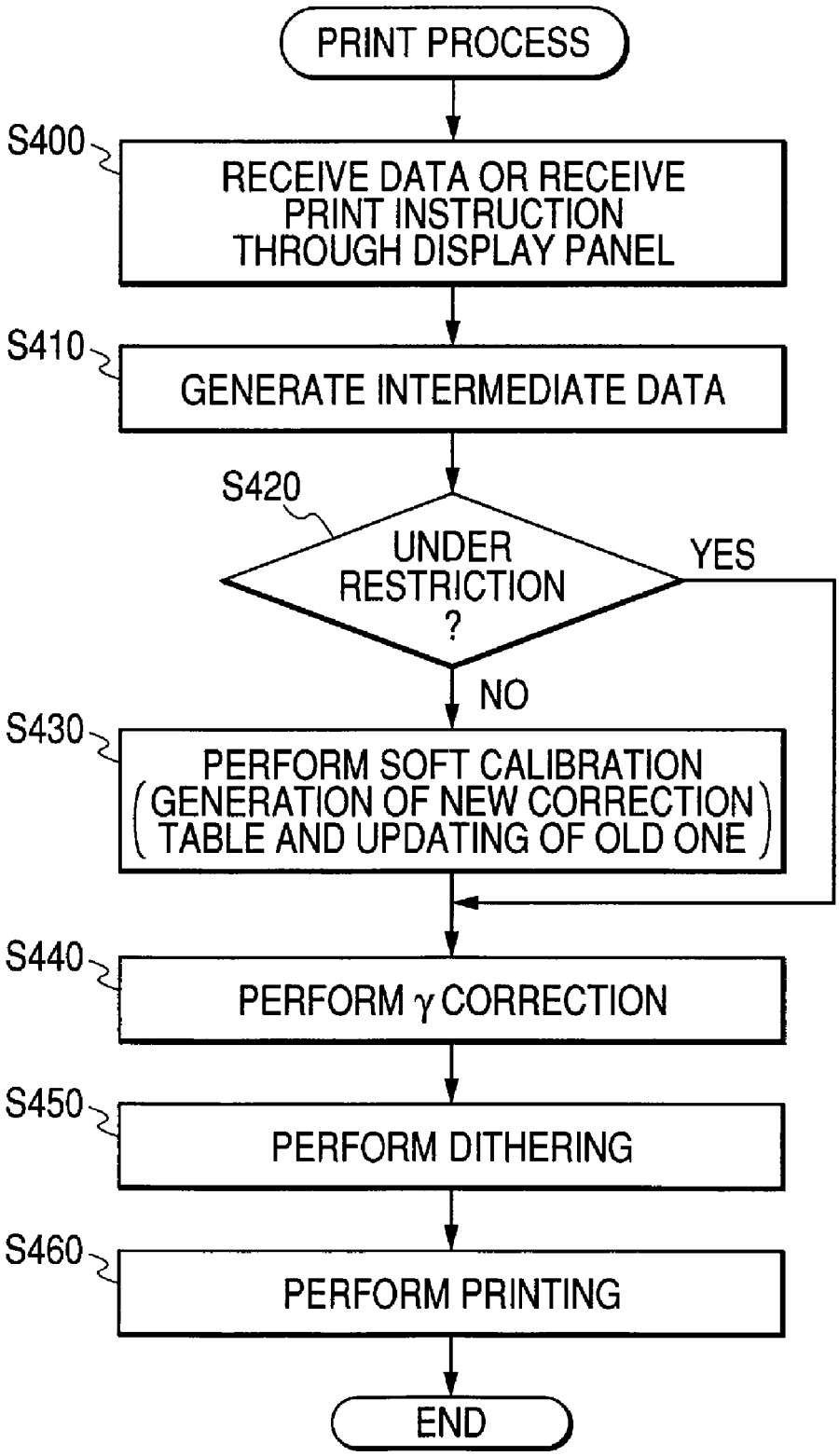
FIG. 8 is a flowchart of a print process.

FIG. 8 is a flowchart of the print process. As shown in FIG. 8, upon a start of the print process, data are acquired at step S400 and intermediate data are generated at step S410. At step S420, it is determined whether or not the above-mentioned execution restriction mode is established. If the execution restriction mode is not established, soft calibration processing is performed at step S430.

The soft calibration processing is updating processing of updating a correction table to be used for correcting the image density. As described above, the densities of density patches were measured in the engine calibration process and the density measurement result is stored in the storage unit (e.g., RAM 93 or nonvolatile memory). In the soft calibration processing, a new correction table (g table) which represents a corresponding relationship between the input level that is given to the printer 1 and the actual output level is generated on the basis of density measurement result stored in the storage unit and the correction table so far stored is replaced by the new one. The correction table corresponds to "density conversion information."

In the soft calibration processing, density values on a print medium that correspond to gradation levels obtained by equally dividing a range of 0% to 100% into 256 parts are calculated by a known interpolation method (e.g., linear interpolation or quadratic curve interpolation) by using density values on a print medium that are estimated on the basis of the density values (e.g., gradation levels of 0%, 10%, 15%, 20%, 25%, 30%, etc.) obtained by actually measuring the densities of the patches on the inter-transfer belt 51 in the engine calibration processing. Correction data are calculated so that the calculated density values are corrected to ideal densities, and the calculated correction data are stored, as a new correction table, in the storage unit such as the RAM 93 or a nonvolatile memory (not shown). The soft calibration processing is thus completed.

As described above, according to the illustrative aspect, the correction table is not updated if the execution restriction mode is established. This effectively prevents a problem that the correction table is altered thoughtlessly by indefinite users and the hue of an image is thereby changed. The engine calibration (density measurement processing) is performed independently of the soft calibration (processing of generating a new correction table and updating the old one), and the soft calibration is restricted according to a restriction setting. Therefore, the hue is not changed thoughtlessly. When necessary, the correction table can be updated quickly with high accuracy on the basis of the stored density measurement result.

After the completion of the soft calibration processing, γ correction processing is performed at step S440. The γ correction processing is processing of causing the generated correction table to be reflected in print data (having corrected values) to be used for printing. That is, in this processing, a correction is performed according to the correction table so that densities included in print data to be used for printing coincide with densities of an intended print image. After the γ correction processing, dithering processing is performed at step S450 and printing on a sheet is performed at step S460. During the printing, densities of the respective colors are corrected by performing the adjustment of the pulse width of a laser beam, the adjustments of the voltages to be applied to the development rollers 37 and the photoreceptor belt charger 45, and other adjustments on the basis of the corrected values produced in the γ correction processing.

Other Illustrative Aspects

The present invention is not limited to the illustrative aspect that has been described above with reference to the drawings. For example, the following illustrative aspects are included in the technical scope of the invention. And other various modifications are possible without departing from the spirit and scope of the invention.

(A) The "operation amount as measured from the preceding calibration" is not limited to the number of printed sheets as long as it can quantitatively indicate the cumulative amount of operation as measured from the preceding calibration. For example, it may be the operation time as measured from the preceding calibration. The operation amount may be an amount of operation performed by an image forming section provided in the image forming system (printer 1).

(B) The restriction setting includes not only a setting that is made on the basis of a user's input (or an administrator's input) but also a setting that is not based on a user's input. For example, the color laser printer 1 itself may make a restriction setting automatically on the basis of a predetermined condition.

(C) Although in the above illustrative aspect the instruction input unit is the input device of the color laser printer 1, it may be an input device of the computer 150. That is, an execution instruction may be input from the computer 150.

(D) Although in the above illustrative aspect the CPU 91 of the color laser printer 1 serves as the control unit, the restriction setting unit, and the determination unit, these means may be provided on the computer 150 side. For example, the CPU of the computer 150 may serve as the control unit, the restriction setting unit, and the determination unit. For example, the system may be configured in such a manner that the computer 150 can perform soft calibration and soft calibration that is based on a user's request is restricted by processing in the computer 150.

(E) Although in the above illustrative aspect the development cartridges 35 that can be replaced on a color-by-color basis are used as the replaceable cartridges, the replaceable cartridges may be such that development cartridges of all the colors are replaced collectively. In this case, a determination result "yes" is produced at step S300 when the integral cartridge has been replaced. Further, a cartridge unit may be formed by combining such a development cartridge with other components (a photoreceptor etc. in the case of a direct tandem type color laser printer).

(F) Although in the above illustrative aspect the engine calibration and the soft calibration are performed separately as the "calibration" in the claims and the two kinds of calibration can be restricted according to a restriction setting, the printer 1 may be configured in such a manner that only one of the two kinds of calibration is restricted.

(G) Although in the above illustrative aspect only the engine calibration is performing in the user calibration process, the soft calibration may also be performed in the user calibration process. For example, the same step as step S430 may be inserted after step S240 in FIG. 5. This allows a user to start updating processing of updating the density conversion information arbitrarily, and makes it possible to restrict such updating processing using a password.

(H) Although in the above illustrative aspect calibration is performed immediately after a user's input of an execution instruction or after predetermined processing is performed after input of an execution instruction, the "calibration execution instruction of a user" is not limited to such an instruction as long as it allows a user to set calibration timing arbitrarily. For example, it includes an instruction by which a user specifies a calibration execution condition (e.g., calibration should be performed every three hours or every 500 sheets).

(I) Although in the above illustrative aspect the color laser printer 1 is of the 4-cycle type, the invention is not limited to the 4-cycle type color laser printer and can also be applied to color laser printers of other types such as the tandem type.

(J) Although in the above illustrative aspect density patches are formed on the inter-transfer belt 51, density patches may be formed on some other member such as the photoreceptor or a sheet transport belt having a sheet transport function.

As described with reference to the illustrative aspects, there is provided the following configurations.

(1) An image forming system including: an instruction input unit that allows a user to input a calibration execution instruction for performing a calibration; a restriction setting unit that sets a restriction setting that restricts performing the calibration; a determination unit that determines whether or not to restrict performing the calibration based on the restriction setting; and a control unit that performs the calibration in response to the execution instruction while the determination unit determines that the calibration is allowed to be performed, and ignores the execution instruction while the determination unit determines that the calibration is restricted from being performed.

(2) The image forming system according to (1), wherein the restriction setting unit sets the restriction setting in accordance with an operation input by the user.

(3) The image forming system according to (1), wherein the determination unit determines that the calibration is restricted from being performed while an operation amount as measured from previously performed calibration is equal to or smaller than a first threshold value.

(4) The image forming system according to (3), wherein the operation amount is an amount of operation performed by an image forming section provided in the image forming system.

(5) The image forming system according to (1), further including an authentication information input unit that allows the user to input authentication information, and wherein the determination unit determines whether or not to restrict performing the calibration based on the restriction setting, on the basis of whether or not the authentication information is certified information.

(6) The image forming system according to (1), further comprises a notification unit that notifies the user to recommend performing the calibration in a case where an operation amount as measured from previously performed calibration is equal to or larger than a second threshold value.

(7) The image forming system according to (1), wherein the determination unit determines that the calibration is allowed to be performed irrespective of the restriction setting in a case where an operation amount as measured from previously performed calibration is equal to or larger than a third threshold value.

(8) The image forming system according to (1), further including a replaceable image forming cartridge, wherein the determination unit determines that the calibration is allowed to be performed irrespective of the restriction setting in a case where the image forming cartridge is replaced.

The image forming cartridge may be a development cartridge as described above with respect to the illustrative aspect, or may be a cartridge that includes a photosensitive member used for forming an image.

(9) The image forming system according to (1), wherein the calibration is density measurement processing of forming density patches and measuring densities of the density patches.

(10) The image forming system according to (1), wherein the calibration is updating processing of updating density conversion information to be used for correcting an image density.

(11) The image forming system according to (8), wherein the calibration is updating processing of updating density conversion information to be used for correcting an image density.

(12) The image forming system according to (10), wherein the control unit performs the density measurement processing at a preset timing and stores the measured densities of the density patches in a storage unit, and wherein the control unit performs the updating processing based on the measured densities stored in the storage unit.

(13) An image forming system including: an instruction input unit that allows a user to input a calibration execution instruction for performing a calibration; a control unit that performs the calibration in response to the execution instruction; and a notification unit that notifies a user to recommend performing the calibration in a case where an operation amount as measured from previously performed calibration is equal to or larger than a notification level.

(14) The image forming system according to (13), wherein the operation amount is an amount of operation performed by an image forming section provided in the image forming system.

(15) An image forming apparatus including: a restriction setting unit that sets a restriction setting that restricts performing the calibration; a determination unit that determines whether or not to restrict performing the calibration based on the restriction setting; and a control unit that performs the calibration in response to an execution instruction input through an instruction input unit while determined by the determination unit that the calibration is allowed to be performed, and ignores the execution instruction while determined by the determination unit that the calibration is restricted from being performed.

(16) The image forming apparatus according to claim (15), wherein the operation amount is an amount of operation performed by an image forming section provided in the image forming system.

According to the configurations of (1) and (15), calibration can be performed when a user determines that calibration is necessary, which makes it possible to form a proper image that is desired by the user. On the other hand, since calibration that is based on a user's request can be prohibited according to restriction setting, trouble (e.g., deterioration of expendables, noise sound, and a change to undesired hue) as caused by performing calibration unconditionally in response to a user's request can be prevented and the convenience is thereby increased.

According to the configuration of (2), since a restriction setting is made according to an arbitrary input manipulation by an administrator, the administrator can determine, when necessary, whether to restrict calibration. As such, this configuration is even higher in convenience.

In the configuration of (3), calibration is omitted in a period when the operation amount is small and hence no serious problems will occur even if calibration is not performed. Therefore, the frequency of calibration operations can be reduced effectively without lowering the image quality.

According to the configuration of (5), since users who can start calibration can be discriminated by using authentication information, a problem that calibration is started thoughtlessly by indefinite users can be prevented effectively.

In the configuration in which calibration is restricted according to a restriction setting, a situation may occur that calibration is not performed over a long period, which may result in a problem that the image quality is lowered without being recognized by a user. In view of this, in the configuration of (6), an alarm is issued if the operation amount has become larger than or equal to the second threshold value. Therefore, if a calibration non-execution period is lasting long, a user can recognize that fact and hence can take a proper measure. This effectively prevents the system from operating in a state of low image quality.

In the configuration in which calibration is restricted according to a restriction setting, a situation may occur that calibration is not performed over a long period, which may result in a problem that the image quality is lowered without being recognized by a user. In view of this, in the configuration of (7), calibration is performed irrespective of the restriction setting if the operation amount has reached a certain level while calibration that is based on a user's request is restricted moderately according to the restriction setting. This effectively prevents the system from operating in a state of low image quality, whereby the image quality is kept high.

In the configuration of (8), calibration is performed irrespective of the restriction setting in a period when the characteristics likely change such as after replacement of a development cartridge. Therefore, whereas calibration that is based on a user's request is restricted moderately, calibration is performed properly in a situation that it should be performed.

The configuration of (9) can effectively prevent undue consumption of expendables and noise sound because the frequency of formation of density patches can be reduced.

The configurations of (10) and (11) can prevent a problem that the density conversion information is altered thoughtlessly by indefinite users and the hue of an image is thereby changed.

According to the configuration of (12), density measurement processing can be performed regularly with preset timing and the density conversion information is updated according to the restriction setting. Therefore, the hue is prevented from being changed thoughtlessly, and, when necessary, the density conversion information can be updated quickly with high accuracy on the basis of a stored density measurement result.

According to the configuration of (13), calibration can be performed when a user determines that calibration is necessary, which makes it possible to form a proper image that is desired by the user. On the other hand, in such a configuration, it is expected that the frequency of calibration operations becomes high. However, according to the configuration of (12), since a notification is issued to a user if the operation amount as measured from the preceding calibration has become larger than or equal to the notification level, the user can determine whether to start calibration using the alarm of the notification unit as a guide. Therefore, a problem that calibration is ordered thoughtlessly by users in a state that the operation amount is small can be prevented.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspect was chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. An image forming system comprising:

an instruction input unit that allows a user to input a calibration execution instruction for performing a calibration;

a restriction setting unit that sets a restriction setting that restricts performing the calibration;

a determination unit that determines whether or not to restrict performing the calibration based on the restriction setting; and a control unit that performs the calibration in response to the execution instruction if the determination unit determines that the calibration is allowed to be performed, and cancels the execution instruction while the determination unit determines that the calibration is restricted from being performed.

2. The image forming system according to claim 1, wherein the restriction setting unit sets the restriction setting in accordance with an operation input by the user.

3. The image forming system according to claim 1, wherein the determination unit determines that the calibration is restricted from being performed while an operation amount as measured from previously performed calibration is equal to or smaller than a first threshold value.

4. The image forming system according to claim 3, wherein the operation amount is an amount of operation performed by an image forming section provided in the image forming system.

5. The image forming system according to claim 1, farther comprising an authentication information input unit that allows the user to input authentication information, and wherein the determination unit determines whether or not to restrict performing the calibration based on the restriction setting, on the basis of whether or not the authentication information is certified information.

6. The image forming system according to claim 1, further comprising a notification unit that provides a notification to the user in a case where an operation amount as measured from a previously performed calibration is equal to or larger than a threshold value, the notification recommending to perform the calibration.

7. The image forming system according to claim 1, wherein the determination unit determines that the calibration is allowed to be performed irrespective of the restriction setting in a case where an operation amount as measured from previously performed calibration is equal to or larger than a threshold value.

8. The image forming system according to claim 1, further comprising a replaceable image forming cartridge, wherein the determination unit determines that the calibration is allowed to be performed irrespective of the restriction setting in a case where the image forming cartridge is replaced.

9. The image forming system according to claim 1, wherein the calibration is density measurement processing of forming density patches and measuring densities of the density patches.

10. The image forming system according to claim 9, wherein the calibration is updating processing of updating density conversion information to be used for correcting an image density.

11. The image forming system according to claim 10, wherein the control unit performs the density measurement processing at a preset timing and stores the measured densities of the density patches in a storage unit, and wherein the control unit performs the updating processing based on the measured densities stored in the storage unit.

12. The image forming system according to claim 1, wherein the calibration is updating processing of updating density conversion information to be used for correcting an image density.

13. An image forming system comprising:

an instruction input unit that allows a user to input a calibration execution instruction for performing a calibration;

a control unit that performs the calibration in response to the execution instruction; and a notification unit that notifies a user to recommend performing the calibration in a case where an operation amount as measured from previously performed calibration is equal to or larger than a notification level.

14. The image forming system according to claim 13, wherein the operation amount is an amount of operation performed by an image forming section provided in the image forming system.

15. An image forming apparatus comprising:

a restriction setting unit that sets a restriction setting that restricts performing the calibration;

a determination unit that determines whether or not to restrict performing the calibration based on the restriction setting; and a control unit that performs the calibration in response to an execution instruction input through an instruction input unit if the determination unit determines that the calibration is allowed to be performed, and cancels the execution instruction while the determination unit determines that the calibration is restricted from being performed.

16. The image forming apparatus according to claim 15, wherein the operation amount is an amount of operation performed by an image forming section provided in the image forming apparatus.

* * * * *